United States Patent [19]

Ingram

[11] Patent Number: 4,991,523

[45] Date of Patent: Feb. 12, 1991

[54] TUFTING APPARATUS

[75] Inventor: Gary L. Ingram, Ooltewah, Tenn.

[73] Assignee: Textile Corporation of America, Ringgold, Ga.

[21] Appl. No.: 366,545

[22] Filed: Jun. 15, 1989

[51] Int. Cl.[5] ..... D05C 15/00

[52] U.S. Cl. ..... 112/80.05; 112/80.08; 112/266.2

[58] Field of Search ..... 112/80.05, 80.08, 80.16, 112/80.31, 80.6, 80.7, 80.71, 222, 266.2

[56] References Cited

U.S. PATENT DOCUMENTS

| | | | |
|---|---|---|---|
| 3,203,388 | 6/1965 | Parlin et al. | 112/410 |
| 3,338,198 | 8/1967 | Short | 112/410 |
| 3,386,403 | 6/1968 | Short | 112/80.08 |
| 3,554,147 | 1/1971 | Spanel | 112/79 |
| 3,756,173 | 9/1973 | Shorrock | 112/79 |
| 3,937,157 | 2/1976 | Spanel et al. | 112/79 |
| 3,937,158 | 2/1976 | Spanel | 112/79 |
| 4,244,309 | 1/1981 | Spanel et al. | 112/79 |
| 4,488,498 | 12/1984 | Smith | 112/80.05 X |
| 4,549,496 | 10/1985 | Kile | 112/79.5 |
| 4,711,190 | 12/1987 | Smith | 112/266.2 |

*Primary Examiner*—Werner H. Schroeder

*Assistant Examiner*—Paul C. Lewis

*Attorney, Agent, or Firm*—Laubscher, Presta & Laubscher

[57] ABSTRACT

Apparatus for producing tufted textile goods employs a plurality of hollow needles which serve as backing openers, the backing openers being carried on a widthwise extending member which is reciprocated in a vertical direction to cause the backing openers to penetrate a backing. Yarn is transported pneumatically through the backing openers and implanted into the backing as yarn turfts, and backing being shifted in the transverse direction by an amount corresponding to the spacing between adjacent backing openers in order to implant a transverse row of tufts. A knife blade is associated with each backing opener and positioned on the opposite side of the backing so as to engage the flat angled surface of the backing opener which forms its pointed tip. The angled surface is formed with an upwardly and inwardly extending slot which serves to capture and center yarn exiting the opening in the angle surface, and which provides a sharp edge which cooperates with the blade for cutting the yarn. The cutting mechanism results in little or no wasted yarn.

24 Claims, 5 Drawing Sheets

FIG. 3A
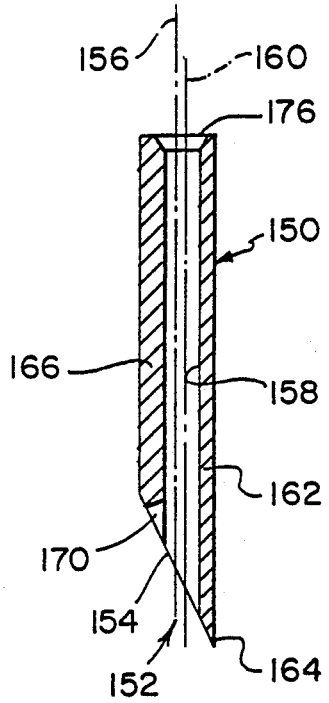
FIG. 3B
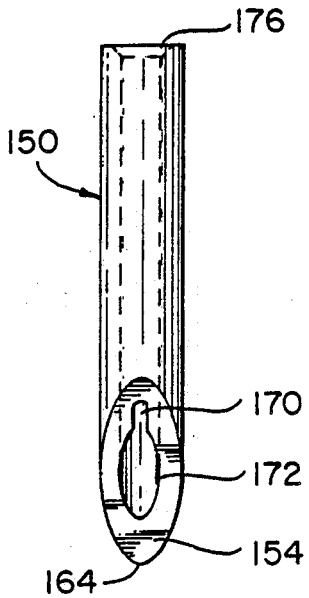
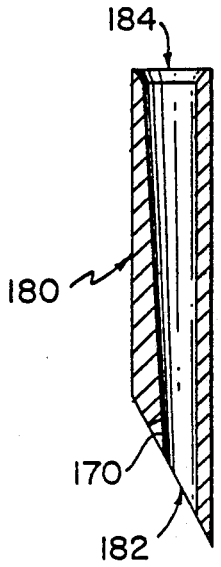
FIG. 4
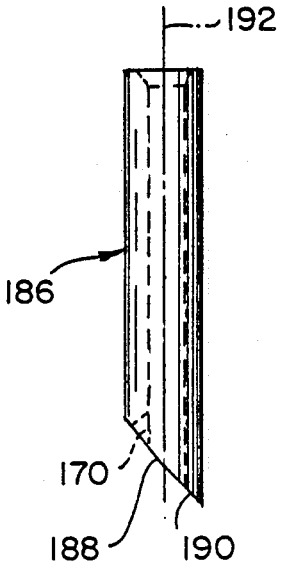
FIG. 5

TUFTING APPARATUS

BACKGROUND OF THE INVENTION

This invention relates generally to apparatus for producing tufted textile goods such as carpet, upholstery, and the like, and more particularly to improved tufting apparatus capable of producing patterned tufted goods.

U. S. Pat. No. 4,549,496 which issued October 29, 1985, to Kile discloses highly advantageous tufting apparatus for producing patterned tufted goods using yarns of different colors or different textures. This apparatus is capable of placing yarn into a backing to create patterns and designs which previously were generally available only from a weaving loom or by using printing techniques. The patented apparatus employs multiple heads spaced across the width of a backing material. Each head comprises a reciprocating backing opener tube for penetrating the backing and for implanting yarn tufts in the backing by feeding yarn through the tube pneumatically. The backing opener is connected to a yarn exchanger into which a plurality of yarns of different colors, for example, are supplied, and a mechanism is included which enables the selection of one or more of the yarns for implantation into the backing for each penetration by the backing opener. The multiple heads are stepped in synchronism across the backing for a distance corresponding to the spacing between the heads in order to implant a transverse row of yarn tufts. The backing is then advanced to the position of the next row and the process is repeated to implant the next row. A computer controls the selection of the yarn implanted by each backing opener for each penetration of the backing in order to produce a desired pattern in the finished goods.

Although the patented apparatus represents a significant advancement in the tufting industry in that it has enabled the production of multicolored and patterned tufted goods at a substantially reduced cost and in a substantially shorter period of time than is possible with conventional weaving looms, it is desirable to improve tufting apparatus embodying the patented invention to reduce costs and further increase production speed. One area in which improved efficiency is desired in practical apparatus embodying the patented invention is in the mechanism which cuts the yarn after it has been implanted into the backing. The Kile patent discloses, and practical apparatus have embodied, a motor-driven rotary cutter associated with each tufting head for cutting the yarn after it has been implanted in the backing. The rotary cutter is positioned on the opposite side of the backing from the head and moves transversely across the backing with the head. At each penetration of the backing, yarn is ejected from the backing opener by the air flowing through the backing opener tube and into the path of a rotating cutter blade which cuts the yarn. This arrangement results in a fair amount of yarn waste. Moveover, since it is necessary to provide clearance between the rotating cutter blade and the backing opener, there is a limit as to how close the rotating cutter can be placed safely to the underside of the backing. As a result, the pile height of the yarn tufts implanted in the backing may be greater than desired and the amount of yarn trimmed during a subsequent finishing operation further contributes to the waste.

A significant factor influencing the production speed of practical apparatus embodying the invention of the Kile patent is the number of tufting heads embodied in the apparatus. The greater the number of heads, the less distance each head must traverse and, accordingly, the faster a row of tufts can be implanted in the backing. As the number of heads increases, however, other problems arise. The increased weight makes it more difficult to move the heads accurately and to maintain their alignment and positions relative to one another.

It is desirable to provide tufting apparatus which avoid the foregoing problems and which afford further improvements in tufting apparatus of the type disclosed in the Kile patent, and it is to these ends that the present invention is directed.

SUMMARY OF THE INVENTION

A significant aspect of the present invention is the provision of apparatus for producing tufted goods which embody an improved yarn cutting mechanism that replaces the rotary cutter disclosed in the Kile patent and described above. The improved cutter is far simpler, lighter, and less expensive than the rotary cutter, and, more importantly, results in little or no wasted yarn.

Briefly summarized, the improved cutting mechanism includes a cutting blade which cooperates with the backing opener tube to provide a shearing-like action for cutting the yarn exiting the backing opener tube. The backing opener tube has a pointed tip at the end of the tube from which the yarn is ejected. The pointed tip is formed by a surface which is angled with respect to the axis of the tube. The backing opener tube is reciprocated so as to penetrate the backing with the pointed tip for implanting yarn tufts, and the blade is positioned adjacent to the underside of the backing so that the blade contacts and slides over the angled surface upon the tip penetrating the backing in order to cut the yarn exiting from the backing opener tube to produce cut pile tufted goods.

In contrast to the rotary cutter which cuts off and discards a loop of yarn at each insertion of yarn into the backing, the present invention does not discard yarn that is cut. Rather, as the backing opener penetrates the backing and proceeds downwardly through the backing to the bottom of its stroke, the angled tip of the backing opener comes into sliding contact with the blade and the yarn is cut between the cutting edge of the blade and the sidewall of the backing opener tube in a shearing-like action. The yarn is cut as the backing opener approaches the extreme end of its downward stroke. As the backing opener is retracted, the cut yarn is left in place in the backing. The distance between the backing and the location of the blade corresponds to the resulting pile height of the yarn. Upon the next penetration of the backing by the backing opener tube, the process is repeated with the blade cutting the yarn as the backing opener approaches the bottom of its stroke. This results in a U-shaped yarn tuft in the backing, with both legs of the yarn tuft being the same length. Since no yarn is cut off and discarded, as in the rotary cutter, there is no waste. Accordingly, the cost of producing the goods is reduced.

To facilitate the operation of the improved cutting mechanism, the backing opener tube may be formed such that the passageway in the tube through which the yarn is conveyed has a centerline which is offset from the axis of the backing opener toward the side of the backing opener at which the pointed tip is located. This provides an increased sidewall thickness at the opposite sidewall from the pointed tip and at the location where the shearing action between the sidewall and the blade occurs. A slot may be formed in the sidewall at this location for receiving the yarn exiting the passageway. The slot serves to center and hold the yarn in place as it is being sheared between the blade and the sharp edge formed in the tube sidewall at the slot.

In another respect, the invention affords an improved tufting apparatus which includes a plurality of reciprocating backing opener tubes, the positions of which are fixed transverse to the direction of advancement of the backing through the apparatus. In order to implant a transverse row of tufts into the backing, the backing itself is shifted transversely in incremental steps corresponding to the spacing between adjacent yarn insertions. This enables the relatively heavy and complex heads of the previous apparatus to be eliminated and replaced by a plurality of closely-spaced backing openers disposed on a common transversely-extending reciprocating bar. This has the advantage of enabling close control over the positions of the backing openers and avoids the possibility of any relative movement between the backing openers. By employing a relatively-close spacing between backing openers, the distance that the backing must be shifted may be kept small. This facilitates accurate shifting of the backing.

In accordance with another aspect of the invention, the improved cutting mechanism may be modified by associating with each cutting blade an actuator device which enables the position of the blade to be varied for selective cutting of the yarn. Upon each penetration of the backing by the backing opener tube, the actuator allows the blade to be moved into and out of a position where the blade contacts the backing opener tube. This enables the yarn to be selectively cut, or not cut, as desired, and enables the production of loop pile, cut and loop pile, and cut pile goods.

Other advantages and features of the invention will become apparent from the description which follows.

BRIEF DESCRIPTION OF THE DRAWINGS

FIGS. 3A and B are, respectively, a longitudinal cross sectional view and a side view taken from the left side of FIG. 3A of a backing opener in accordance with the invention;

FIG. 4 is a longitudinal cross sectional view of another embodiment of a backing opener in accordance with the invention, the backing opener of FIG. 4 having a tapered bore;

FIG. 5 is a side view of yet another embodiment of a backing opener in accordance with the invention, the embodiment of FIG. 5 having a stepped pointed tip formed by a pair of surfaces at different angles;

DESCRIPTION OF PREFERRED EMBODIMENTS

As previously indicated, the present invention is especially adapted for use with apparatus for producing tufted textile goods, such as carpet, wall coverings, or upholstery, and affords improved tufting apparatus of the type disclosed in the previously referenced U.S. Pat. No. 4,549,496 to Kile, the disclosure of which is incorporated by reference herein. Details of structure and operation of the improved tufting apparatus of the present invention which are not directly related to the present invention and which are described in the Kile patent will not be repeated here. Rather, reference may be had to the Kile patent for the details of such structure and operation.

Figure 1:
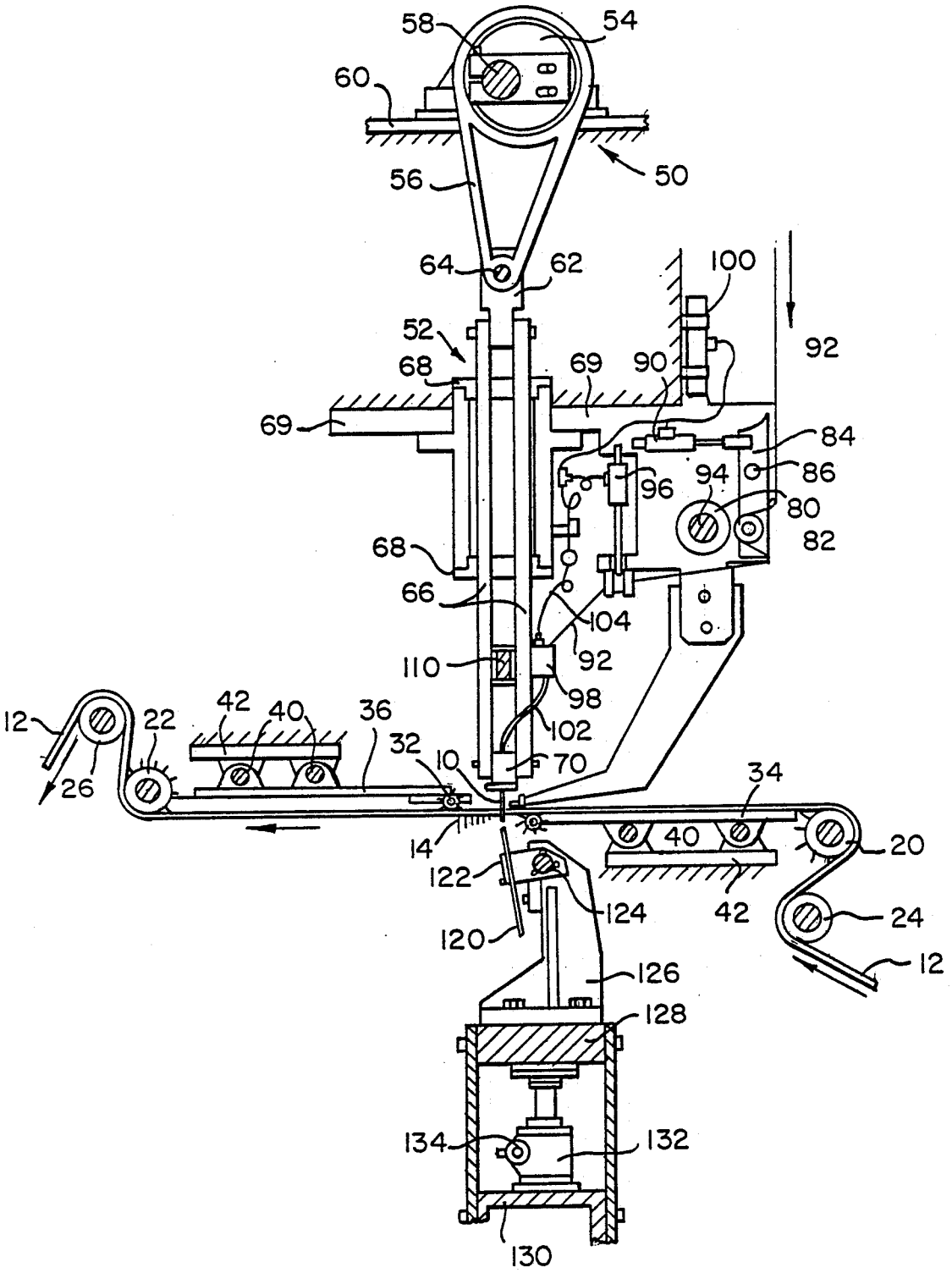
FIG. 1 is a longitudinal side view, partially in cross section and partially diagrammatic, of tufting apparatus embodying the invention.

FIG. 1 is a longitudinal side view, partially in cross section and partially diagrammatic, illustrating improved tufting apparatus in accordance with the invention. The tufting apparatus of FIG. 1 may comprise a reciprocating backing opener tube 10 for penetrating a primary backing 12 to implant yarn tufts 14 therein. The primary backing 12, which may be in the form of a continuous running web, for example, may be advanced longitudinally past the reciprocating backing opener (to the left in FIG. 1 as indicated by the arrow) by a backing advanced system which may comprise a pair of pin rollers 20 and 22 which are driven (as by electric motors which are not illustrated) at slightly different rotational speeds so as to maintain the backing under tension as it passes the reciprocating backing opener. The backing advanced system may further comprise a pair of guide rollers 24 and 26 which cooperate with pin rollers 20 and 22, respectively, to guide the backing. As shown in the figure and for reasons which will be described in more detail shortly, a second pair of pin rollers 30 and 32, which may have smaller diameters than pin rollers 20 and 22, may be located closely adjacent to the reciprocating backing opener 10 on opposite sides of the backing. Pin rollers 30 and 32 provide better control of the backing in the area where the tufts are implanted. As shown in the figure, pin roller 30 may be carried on a bed plate 34 at the lower side of the backing and be disposed adjacent to the location at which the backing opener penetrates the backing. Pin roller 32 may be carried on a second plate 36 disposed at the upper side of the backing and be located just downstream from the reciprocating backing opener. Plates 34 and 36 are preferably transversely shiftable for reasons which will be described.

Pin rollers 20 and 22 may also be carried on the shiftable plates 34 and 36, respectively, as indicated in the figure. To enable movement each of the plates 34 and 36 may be carried on a pair of transversely extending shafts 40 which are supported by fixed portions 42 of the frame of the apparatus. Plates 34 and 36 may be mechanically connected together and to a transverse positioning mechanism (not illustrated) which enables the plates as well as the pin rollers and their associated drive system to be shifted in unison transversely to the direction of advancement of the backing. This produces a corresponding transverse shifting movement of the backing, which is desirable for reasons which will be described shortly. The transverse positioning mechanism may be any of a number of commercially available devices, such as pneumatic or hydraulic cylinders, which are capable of producing very small and precisely controlled movements. Preferably, the positioning mechanism enables precisely controlled movements of the order of a tenth of an inch or less. Rollers 24 and 26 may also be shifted transversely along with pin rollers 20 and 22. This may be accomplished by a second, less precise shifting mechanism.

Backing opener 10 may be reciprocated by an adjustable cam assembly 50 which is coupled to the backing opener by a link assembly 52. The adjustable cam assembly may comprise a circular cam lobe member 54 rotatably supported by bearings within a circular portion of a yoke member 56. The cam lobe member may be carried on and driven by a transversely extending rotating shaft 58 which is offset from the center of the cam lobe member. Shaft 58 may be supported by bearings on a fixed portion 60 of the frame as shown. The link assembly may comprise a coupling link 62 which is pivotally connected to yoke member 56 as shown at 64 and connected to a pair of vertically extending link members 66 which are guided for vertical reciprocating movement by linear bearings 68 supported by other fixed portions 69 of the frame. The lower ends of link members 66 are connected to a yarn exchanger 70 which carries the backing opener 10. Upon rotation of shaft 58, cam lobe member 54 rotates to impart reciprocating movement to yoke member 56 and, in turn, a similar movement to the backing opener via the link assembly to cause the backing opener to penetrate the backing repetitively.

The tufting apparatus of FIG. 1 also includes systems for supplying and controlling the yarn which is implanted into the backing. These may systems include a yarn feed system for positively supplying a predetermined length of yarn to the yarn exchanger. This system may comprise a yarn feed roller 80 which cooperates with a second roller 82 carried on a movable member 84 which is pivotally supported at 86 on frame portion 69. Roller 82 may be urged into engagement with feed roller 80 by means of a pneumatic actuator 90 or the like which is connected to movable member 84 and which pivots the member to urge rollers 80 and 82 into contact with one another. Yarn 92 may be guided around roller 82 so as to be between the engaging surfaces of rollers 80 and 82. Feed roller 80 may be supported on an incrementally rotated drive shaft 94 so that upon the shaft being rotated yarn is positively fed to yarn exchanger 70 via a yarn pullback mechanism 96 and via a pneumatic manifold 98. Pneumatic manifold 98 may receive a plurality of different yarns (only one yarn 92 being illustrated in FIG. 1) along with pressurized air from a pneumatic supply device 100. Each yarn strand entering manifold 98 is fed to yarn exchanger 70 through a separate supply tube 102 which connects the manifold to the yarn exchanger. A separate air line 104 for each yarn tube 102 may be connected to manifold 98 to enable compressed air to be injected into each tube in a controlled manner to transport the yarn pneumatically through the tube to the backing opener.

Manifold 98, yarn supply tubes 102 and yarn exchanger 70 together function as the yarn exchanger described in the Kile patent and may operate in a similar manner. A particular yarn may be selected for implantation into the backing by appropriately controlling pneumatic actuator 90 to pivot member 84 so that roller 82 is moved into engagement with the yarn feed roller 80, by controlling yarn pullback mechanism 96 to release the yarn, and by controlling the compressed air supplied to manifold 98 to transport the selected yarn to the yarn exchanger. As described in the referenced Kile patent, at each penetration of the backing by the backing opener one or more yarns, or no yarn, may be implanted into the backing, as desired, by appropriate control of the yarn supplying systems. Yarn exchanger 70 serves to guide the plurality of yarns entering the yarn exchanger into the inlet end of the backing opener tube so that the selected yarn or yarns may be transported through the backing opener and implanted into the backing.

The tufting apparatus described in the Kile patent employs a plurality of tufting heads which are stepped transversely in synchronism across the backing. In contrast, the tufting apparatus in FIG. 1 may employ a plurality of transversely stationary backing openers which may be connected together, as by a transversely extending bar 110. The apparatus may employ several adjustable cam assemblies 50 spaced transversely across the width of the backing and connected to shaft 58 to reciprocate the backing openers in synchronism to penetrate the backing. Each backing opener implants one or more selected yarns as determined by a control system such as a computer which controls the yarn supplying and control systems of the apparatus. In order to implant a transverse row of tufts, the backing is shifted transversely, as previously described, in small increments corresponding to the spacing between adjacent tufts. By using a large number of backing openers with a relatively small spacing between adjacent backing openers, e.g. 2.5 inches, the backing need be shifted transversely only by this rather small total distance in order to implant a complete transverse row of tufts. The combination of the shifting large diameter pin rollers 20 and 22 and the small diameter pin rollers 30 and 32 spaced closely adjacent to the backing opener region afford good control over the backing as it is shifted transversely and avoid any tendency of the backing to skew. Rollers 24 and 26, which respectively guide the backing onto pin roller 20 and from pin roller 22, may also be shifted transversely by a separate shifting mechanism as previously indicated which need not be as precisely controlled as the mechanism which shifts the plates and pin rollers in the region where the backing is being tufted.

As previously noted, this backing shifting arrangement has a number of advantages over the earlier moving head apparatus of the Kile patent. It enables the relatively heavy and complex moving heads of the earlier apparatus to be eliminated. This simplifies the apparatus, affords closer control over the positions of the backing openers and avoids the possibility of relative movements between the backing openers, and increases production speed.

Figure 2:
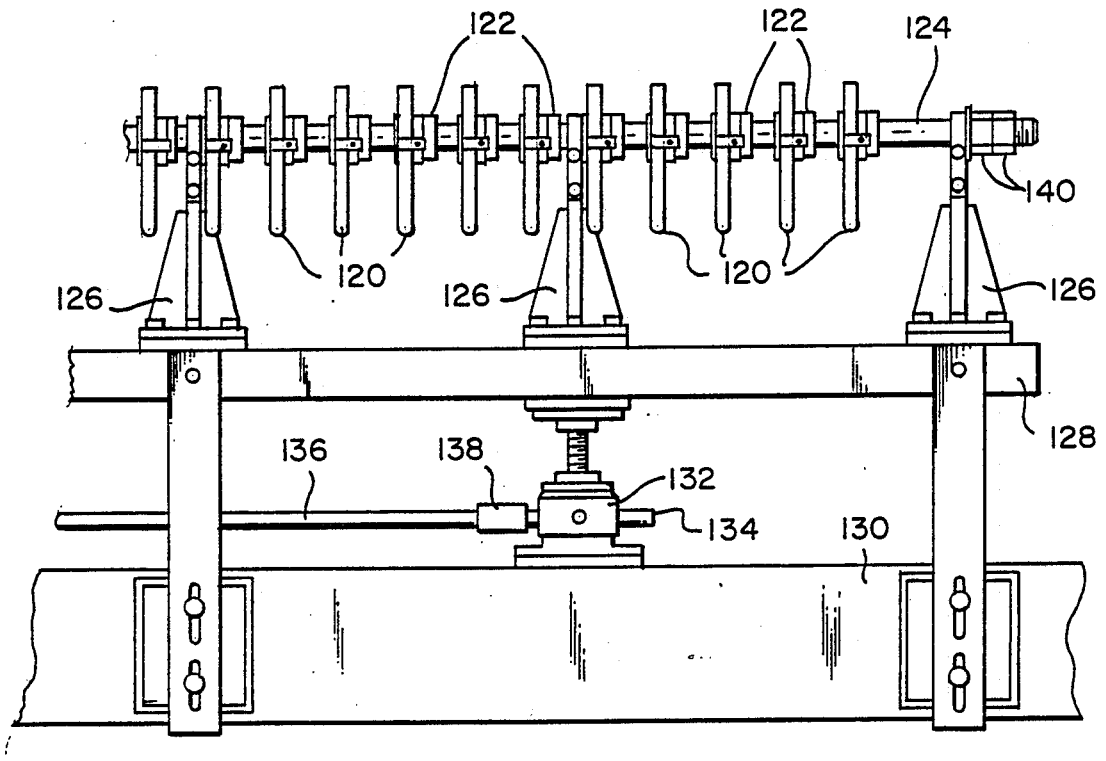
FIG. 2 is a transverse side view of a portion of a knife block assembly of the apparatus of FIG. 1.

Another significant aspect of the apparatus of FIG. 1 is the improved yarn-cutting mechanism of the invention which results in little or no wasted yarn in the production of cut pile goods. As shown in FIGS. 1 and 2, and as will be described in more detail, the improved tufting apparatus of the invention may include a cutting mechanism comprising a separate knife blade 120 for each backing opener. The blades are disposed on the opposite side of the backing from the yarn exchangers and the reciprocating mechanism for the backing openers, as indicated in FIG. 1. As will be described, the blades are arranged to cooperate with the backing openers by sliding over the angled surfaces which form the pointed tips of the backing opener in a shearing-like action to cut yarn that is ejected from the backing openers.

As shown in the figures, knife blade 120 may comprise a flat elongated strip of metal, such as steel, which is held clamped in a knife block 122 disposed on a transversely extending keyed shaft 124. As best illustrated in FIG. 2, shaft 124 may be supported by several transversely spaced brackets 126 connected to a transversely extending frame member 128. Brackets 126 may clamp tightly to shaft 124 to prevent movement of the shaft. Frame member 128 is preferably supported on a fixed member 130 of the apparatus frame by several screw-type jacks 132 (only one being shown in the figures) which are spaced transversely the width of the apparatus. The control shafts 134 of the jacks may be connected together by control rods 136 and bushings 138, as shown, so that the jacks may be lowered and raised in unison to adjust the positions of the knife blades relative to the backing. Normally, shaft 124 may be held stationary by the brackets 126. The ends of the shaft may be threaded and clamped against a corresponding end bracket 126 by a pair of nuts 140, as shown in FIG. 2 for the left end of the shaft. The nuts and the supporting brackets prevent the shaft from rotating or moving in a transverse direction and hold the shaft stationary. Upon loosening the clamp brackets 126 and nuts 140, the shaft may be rotated in order to change the angle between the knife blade and the backing opener and the force with which the blade contacts the backing opener, as well as to shift the knife blades transversely a small amount relative to the backing openers. This shifting varies the region of the knife blade contacted by the backing opener to compensate for dulling of the knife blade caused by repeated engagement between the knife blade and the backing opener. The knife blades and backing openers are preferably formed of hardened steel or other suitably treated material to afford long wearing operation. Nevertheless, the blades may have a tendency to become dull during use, and the arrangement showing in FIG. 2 is convenient for shifting the knife blades a small amount relative to the backing openers to compensate for dulling.

FIGS. 3A and B illustrate a preferred form of backing opener in accordance with the invention. As shown, the backing opener may comprise a hollow tube 150 having a pointed tip 152 formed by a generally planer surface 154 which is angled relative to the axis 156 of the tube, preferably at an acute angle of the order of 20 degrees, for example. The bore 158 of the tube is preferably offset from the tube axis 156. The center line 160 of the bore may be offset from the axis so that the bore is disposed toward the side wall 162 of the tube adjacent to the extreme lower end 164 of its pointed tip. This increases the thickness of the opposite side wall 166, which is desirable since it increases the length of a slot 170 in that side wall. As shown in FIG. 3B, the opening 172 of bore 158 in surface 154 has an elliptical shape. Preferably, slot 170 is formed at the upper (in the figures) region of the elliptical opening in surface 154, as best illustrated in FIG. 3B, and such that the bottom wall of the slot is upwardly angled away from the tip at an obtuse angle relative to the angled surface 154 and inwardly toward the axis of the tube, thereby forming a sharp edge in surface 154, as best illustrated in FIG. 3A.

As will be described in more detail shortly, slot 170 serves to capture and center yarn exiting opening 172 in the backing opener tube and holds the yarn in place while it is being cut by the knife blade. The increased thickness of side wall 166 provides an increased length for slot 170 which aids in this function. As is shown in FIGS. 3A–B the bore 158 at the upper end 176 of the backing opener may be beveled to facilitate the entry of yarn.

FIGS. 4 and 5 illustrate alternative embodiments of the backing opener tube which may be employed. In FIGS. 3A–B, the backing opener tube 150 is provided with a bore 158 having a substantially constant diameter over the length of the tube. In contrast, the backing opener 180 of FIG. 4 has a bore which is tapered from a relatively small opening 182 at the pointed tip to a somewhat larger diameter opening 184 at the opposite end of the tube as shown. The larger opening at the upper end of the tube facilitates feeding yarn into the bore.

In the embodiment of the backing opener 186 shown in FIG. 5, the pointed tip is formed by two planer surfaces 188 and 190 which are at different angles relative to the tube axis 192. The lower surface 190 of the backing opener of FIG. 5 may be at a somewhat greater angle relative to the axis of the tube than surface 188 and the surfaces which form the pointed tips of the backing openers 150 and 180. This reduces the pointedness of the tip as well as the distance between the sharp edge provided by slot 170 and the extreme lower end of the pointed tip which permits a corresponding decrease in the length of the stroke required by the reciprocating mechanism of the apparatus to enable the backing opener to penetrate the backing.

FIGS. 6A–E comprise a series of figures which illustrate the operation of the improved cutting mechanism of the invention. FIGS. 6A–D illustrate a sequence of different positions of a backing opener 150 during its downward stroke. Yarn 200 is being fed through the backing opener and implanted in backing 204.

Figures 6A, 6B, 6C, 6D, 6E:
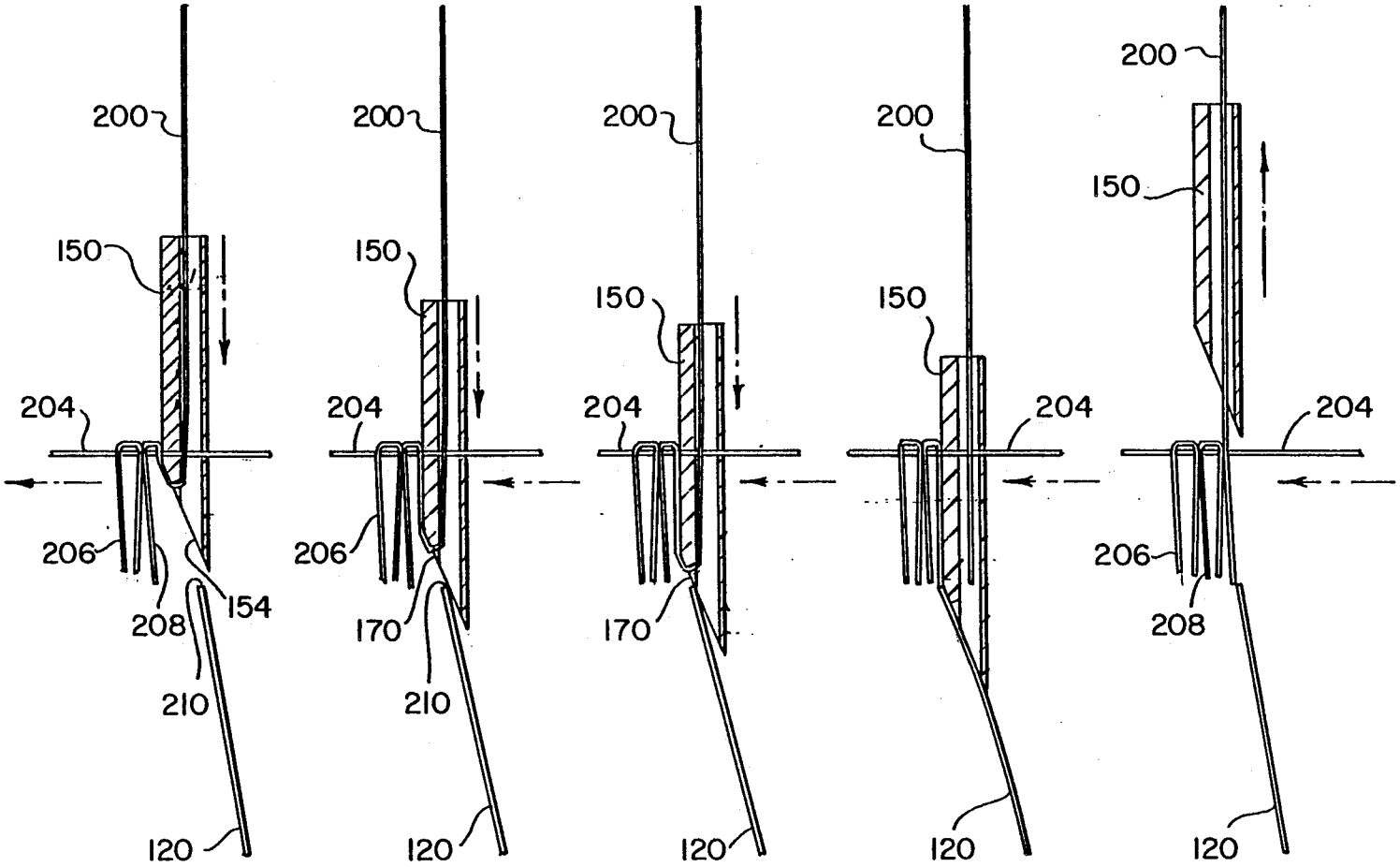
FIGS. 6A–E are a series of diagrammatic views illustrating the operation of an improved yarn cutting mechanism of the invention.

In FIG. 6A, a first U-shaped tuft 206 of yarn has already been implanted in the backing, and the backing opener is shown after it has penetrated the backing in a downward stroke to implant the second half of an adjacent tuft 208. In FIG. 6A, the backing opener has not contacted the knife blade 120. As the backing opener continues its downward stroke, however, the angled surface 154 at the tip of the backing opener contacts the knife blade as shown in FIG. 6B. As shown, the knife blade 120 is not disposed vertically and parallel to the axis of the backing opener tube. Rather, the knife blade is preferably disposed at a small acute angle relative to the vertical axis of the backing opener so that when the angled surface 154 of the backing opener contacts the blade, the force imparted to the cutting edge 210 of the blade tends to bend it over (to the left in the figures). This facilitates the cutting edge sliding along the surface rather than being directly impacted with a downward force in the plane of the blade. The resiliency of the steel blade keeps the blade in contact with the backing opener as it slides over surface 154.

FIG. 6C illustrates the position of the backing opener just prior to the yarn being cut by the knife blade. As shown, as the backing opener proceeds downwardly through the backing, the yarn is located in slot 170 in the backing opener tube and tends to conform to the flat upwardly angled surface of the slot which forms the sharp edge in the side wall of the tube. This captures and centers the yarn. As the backing opener proceeds downwardly, the knife blade slides over the angled surface of the backing opener and cooperates with the sharp edge provided by slot 170 in a shearing-type action to cut the yarn. FIG. 6D illustrates the backing opener after the yarn has been cut, and FIG. 6E illustrates the backing opener after it has been removed from the backing.

As shown in FIG. 6A–E, the improved cutting mechanism of the invention produces no wasted yarn. The yarn is cut at a length corresponding substantially to the desired pile height of the tufted goods. The only waste involved is that which would result from a subsequent finishing operation in which a small amount of yarn at the tips of the tufts is sheared off to level the pile height. Since there is no wasted yarn with the cutting mechanism of the invention, the cost of producing the tufted goods is reduced. Moreover, the cutting mechanism is rather simple. It requires no moving or complex components, such as in the rotary cutter of the Kile patent, and the only maintenance required is replacing or sharping the blades as they dull.

Figure 7:
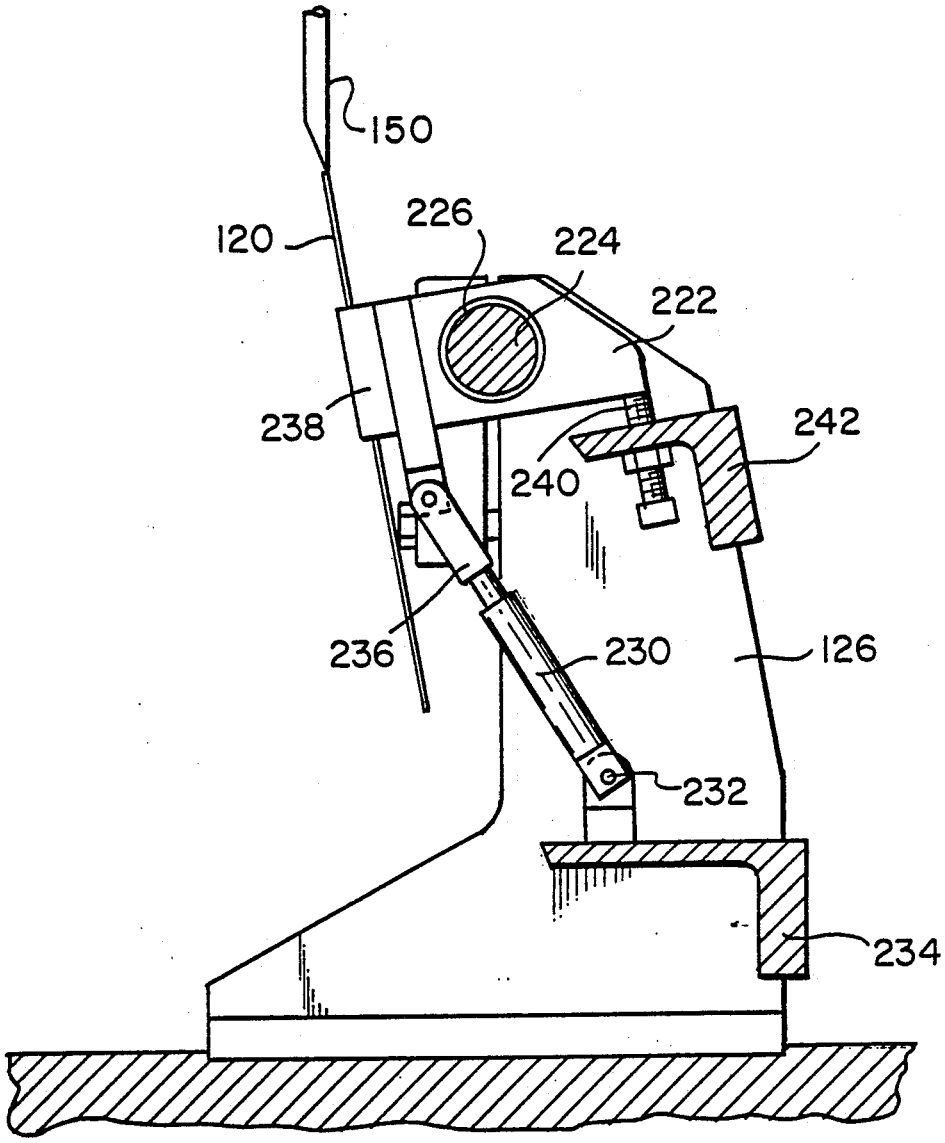
FIG. 7 is a longitudinal cross sectional view of a modification to the cutting mechanism of the invention which enables control of individual knife blades to enable selective cutting of yarn tufts.

FIG. 7 illustrates a modification to the cutting mechanism of the invention which enables selective cutting of yarn and the production of cut loop textile goods. The modification enables the position of knife blade 120 to be selectively controlled for each penetration of the backing by backing opener tube 150 so that the knife blade may be moved between a first position (the position illustrated in FIG. 7) at which it contacts the backing opener to cut the yarn exiting from the backing opener, and a second position at which the knife blade is pivoted (counterclockwise in the figure) away from the backing opener so that the knife blade does not contact the backing opener and, accordingly, does not cut the yarn. In the first position, where the knife blade cuts the yarn, cut pile goods are produced. In the second position, where the blade does not cut the yarn, loop pile is produced. Cut loop, a combination of cut pile and loop pile, may be produced by appropriate control of the blade position.

As shown in FIG. 7, knife blade 120 may be held in a knife block 222 which is supported on a transversely extending shaft 224 by means of a bearing 226 which enables the knife block to pivot easily relative to the shaft. Shaft 224 may be clamped by bracket 126, in the same manner previously described for shaft 124, to prevent the shaft from rotating. Knife block 222 may be pivoted on shaft 224 by a positioning member 230, such as a pneumatic actuator, e.g. an air cylinder, or the like. As indicated in the figure, the pneumatic actuator may have its cylinder portion pivotally connected at 232 to a first transversely extending angle member 234 and may have its piston rod portion 236 pivotally connected to a depending member 238 of knife block 222. In the arrangement shown in FIG. 7, positioning device 230 is shown in an actuated condition with the piston extended. This causes knife block 222 to pivot clockwise (in the figure) about shaft 224 to a first position determined by an adjustable stop 240, which may comprise a bolt threaded through a second transversely extending angle member 242. Stop 240 sets the appropriate position of blade 120 so that it contacts backing opener 150, as previously described, to cut the yarn upon the backing opener penetrating the backing. When positioning device 230 is deactuated, the piston is retracted (as by a return spring) which pivots the knife block counterclockwise in the figure and moves the knife blade 120 out of position to contact the backing opener. In this second position, the knife blade does not cut the yarn, thereby leaving a loop in the backing upon the backing opener being retracted.

Each of the plurality of knife blades of tufting apparatus in accordance with the invention may have its own positioning device 230, and each positioning device may be individually controlled in the manner just described upon each penetration of the backing by its associated backing opener tube. This affords selective cutting of the yarn exiting each backing opener, and enables the production of cut loop goods. If all loop pile carpet is to be produced, the knife blade would be engaged only when a change in yarn color is desired.

The individual actuators 230 may be controlled by a computer, for example, in accordance with a desired pattern.

Although in the embodiment illustrated in the figures the reciprocating backing openers and their corresponding knife blades are held stationary, the same cutting mechanism may also be employed with a moving backing opener such as the traversing head illustrated in the Kile patent.

While preferred embodiments of the invention have been shown and described, it will be appreciated by those skilled in the art that changes in these embodiments may be made without departing from their principles and the spirit of the invention, the scope of which is to defined by the appended claims.

I claim:

1. Apparatus for producing tufted goods from a backing web and a length of continuous yarn, comprising:

(a) backing web support means for supporting the backing web;

(b) a backing opener tube containing a longitudinally-extending through passageway and including at one end a pointed tip formed by an angled surface that is angled with respect to the longitudinal axis of the tube, said backing opener tube being arranged generally normal to said backing web with said pointed tip having a pointed extremity adjacent said web;

(c) means for axially reciprocating said backing opener tube between positions in which said pointed tip penetrates through and is withdrawn from said web, respectively;

(d) means for transporting the length of yarn successively through said passageway and outwardly through said pointed tip; and (e) blade means operable in sliding contact with said angled surface for severing a yarn tuft from said length of continuous yarn.

2. The apparatus of claim 1, wherein said backing opener tube contains, adjacent the portion of the angled surface remote from said pointed tip, a slot extending toward the longitudinal axis of said tube for receiving the length of yarn exiting said passageway, said slot cooperating with said angled surface to define a sharp edge which cooperates with said blade to cut the yarn tuft from said yarn length.

3. The apparatus of claim 2, wherein the longitudinal axis of said passageway is laterally displaced relative to the longitudinal axis of said tube in the direction of the extremity of said pointed tip, said slot having a bottom wall extending angularly toward the longitudinal axis of said passageway and cooperating with said angled surface to define said sharp edge.

4. The apparatus of claim 1, wherein said yarn transporting means comprises pneumatic transporting means.

5. The apparatus of claim 4, wherein said pneumatic transporting means applies a force to the yarn in a direction to eject the yarn from said pointed tip; and further including means for controlling the length of yarn exiting said pointed tip, thereby to provide in the backing web a yarn tuft having a predetermined length.

6. The apparatus of claim 5, wherein said pneumatic transporting means is operative to hold the yarn in the backing web when said reciprocating means removes said backing opener tube from the backing web.

7. The apparatus of claim 1, wherein the passageway in the backing opener tube is tapered from a small opening in the surface at the tip of the tube to a larger opening at an opposite end of the tube.

8. The apparatus of claim 1, wherein said angled surface is flat and said blade means comprises a flat member having a cutting edge, and further including means for holding said blade means at an angle with respect to said angled surface such that said angled surface slidingly contacts said cutting edge when said tube pointed end is in the web penetrating position.

9. The apparatus of claim 8, wherein said blade is resilient, and further wherein said holding means includes means for varying the angle between said blade and said angled surface.

10. The apparatus of claim 8, and further comprising means for selectively controlling said holding means to move said blade means out of a position at which said cutting edge contacts said angled surface so that yarn exiting said backing opener tube is not cut.

11. The apparatus of claim 10, wherein said selective controlling means comprises a positioning device for moving the blade out of said position at which the cutting edge contacts the angled surface, and means for operating the positioning device upon each penetration of the backing by the backing opener tube to afford selective cutting by the yarn.

12. The apparatus of claim 1, and further including:

(f) means for angularly adjusting said blade means relative to said backing opener tube.

13. The apparatus of claim 12, and further including (g) advancing means for longitudinally advancing the backing web, a plurality of said backing opener tubes being arranged in spaced relation transversely of the backing web, said backing opener tubes being normal to the backing web and being reciprocatable by said reciprocating means for implanting yarn tufts in said backing web, respectively; and (h) means for laterally displacing said backing web relative to said backing opener tubes, thereby to implant a transverse row of tufts in the backing web.

14. Apparatus for producing tufted goods from a backing web and a length of continuous yarn comprising an elongated backing opener tube for implanting yarn tufts in the backing web, said tube containing a longitudinal through passageway and including at a first end a pointed tip defined by an angled surface that is angularly arranged relative to the longitudinal axis of said backing opener tube, said tube also having a second end, said passageway forming an opening in said angled surface, said tube containing in said opening a slot cooperating with said angled surface to define a sharp edge, whereby when said yarn length is introduced into said tube through said second end, through said passageway and out of said opening, the yarn will be captured and centered within said slot during the cutting of the yarn by the cooperation between a cutting blade and said sharp edge.

15. The apparatus of claim 14, wherein said slot (170) includes a bottom wall that is arranged at an obtuse angle relative to said angled surface.

16. The apparatus of claim 14, wherein said angled surface is flat, and further comprising cutting means including a blade, and means for operating said blade to engage and slide over said angled surface.

17. The apparatus of claim 14, wherein the passageway is sized to enable a plurality of yarns to pass therethrough simultaneously.

18. The apparatus of claim 14, wherein the passageway has a substantially constant diameter.

19. The apparatus of claim 14, wherein the passageway is tapered from a small opening contained in said angled surface to a larger opening contained in said second end.

20. The apparatus of claim 14, wherein the angled surface of the backing opener comprises a first flat surface having a first angle with respect to the axis of the tube and a second flat surface having a second angle with respect to the axis, the first surface extending from the tip at a first side of the tube to an intermediate region of the angled surface, and the second surface extending from the first surface at the intermediate region to an opposite side of the tube, the slot being located in said second flat surface adjacent to said opposite side of the tube.

21. Apparatus for producing tufted goods from a backing web and a length of continuous yarn, comprising:

(a) a backing opener tube having a pair of ends one of which includes a pointed tip defined by an angled surface, said backing opener tube containing a longitudinal through passageway extending to the other end of said tube;

(b) means for supporting the backing web adjacent said one end of and generally normal to said backing opener tube;

(c) means for reciprocating said backing opener tube axially between penetrating and withdrawn positions relative to the backing web, respectively;

(d) means for supplying the yarn from the other end of said backing opener tube through said passageway and outwardly from said angled surface;

(e) blade means displaceable between activated and de activated positions relative to said angled surface, said blade means in the activated position being arranged to contact and slide across said angled surface to cut the yarn extending outwardly from said angled surface; and (f) means operable upon each penetration of the backing web by said backing opener tube for displacing said blade between said activated and de-activated positions, thereby to enable selective cutting of the yarn.

22. The apparatus of claim 21, wherein said varying means comprises a blade holder; means supporting said blade holder for pivotal movement between said activated position at which the blade contacts the angles surface upon penetration of the backing and said de-activated position at which the blade does not contact the angled surface; and actuator means for controlling the operation of said blade holder means between said activated and de-activated positions.

23. The apparatus of claim 22 further comprising adjusting means for varying the first position of the blade in order to vary the contact force between the blade and the angled surface.

24. The apparatus of claim 21, wherein the varying means comprises a fluid-operated actuator for varying the position of the blade.

* * * * *